US006856292B2

(12) United States Patent
Kuramoto et al.

(10) Patent No.: US 6,856,292 B2
(45) Date of Patent: Feb. 15, 2005

(54) PHYSICALLY SMALL ANTENNA

(75) Inventors: Akio Kuramoto, Tokyo (JP); Kousuke Tanabe, Tokyo (JP); Takao Koizumi, Tokyo (JP)

(73) Assignee: NEC Corporation, Tokyo (JP)

( * ) Notice: Subject to any disclaimer, the term of this patent is extended or adjusted under 35 U.S.C. 154(b) by 31 days.

(21) Appl. No.: 10/329,415

(22) Filed: Dec. 27, 2002

(65) Prior Publication Data

US 2003/0132885 A1 Jul. 17, 2003

(30) Foreign Application Priority Data

Jan. 11, 2002 (JP) ..... 2002-004480

(51) Int. Cl.[7] ..... H01Q 1/32
(52) U.S. Cl. ..... 343/702; 343/835
(58) Field of Search ..... 343/700 MS, 702, 343/829, 872, 752, 750

(56) References Cited

U.S. PATENT DOCUMENTS 5,294,938 A * 3/1994 Matsuo et al. ..... 343/829
5,900,845 A 5/1999 Mandai et al.
5,936,593 A 8/1999 Mandai et al.
6,127,987 A * 10/2000 Maruyama et al. ..... 343/835

FOREIGN PATENT DOCUMENTS

| | | |
|---|---|---|
| JP | 8-84019 | 3/1996 |
| JP | 8-97626 | 4/1996 |
| JP | 9-74308 | 3/1997 |
| JP | 9-74309 | 3/1997 |
| JP | 3041690 | 7/1997 |
| JP | 10-41736 | 2/1998 |

* cited by examiner

*Primary Examiner*—James Vannucci
(74) *Attorney, Agent, or Firm*—Foley & Lardner LLP

(57) ABSTRACT

A physically small antenna having a wide bandwidth that facilitates the inspection of the attachment to the printed circuit board. The antenna is provided with a dielectric plate having a rear surface, a conductive plate disposed on the rear surface, a vertical element extending in a direction perpendicular to the rear surface. The vertical element includes a dielectric bar, an end of which is attached to the rear surface, and a conductive shell covering a side and an opposite end of the dielectric bar to be attached to the conductive plate.

19 Claims, 16 Drawing Sheets

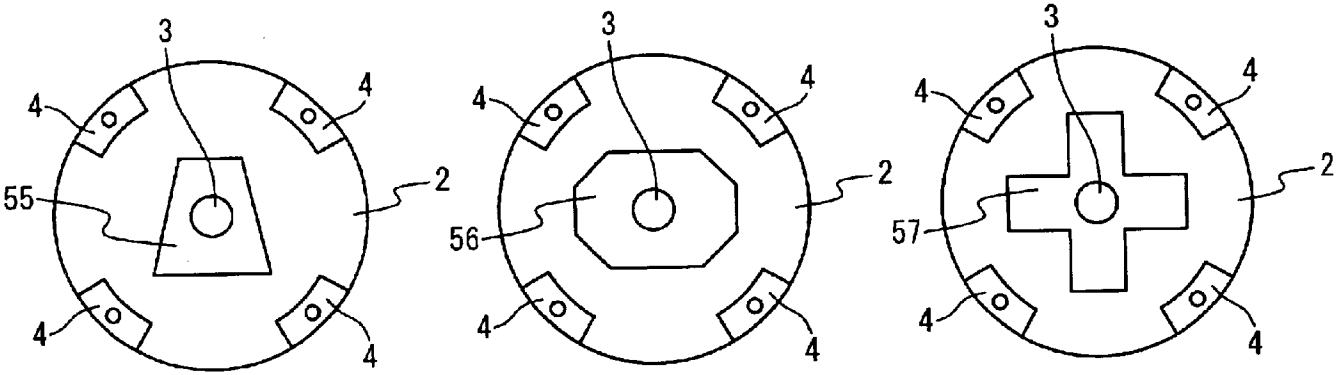
Fig. 15A
Fig. 15B
Fig. 15C
Fig. 15D
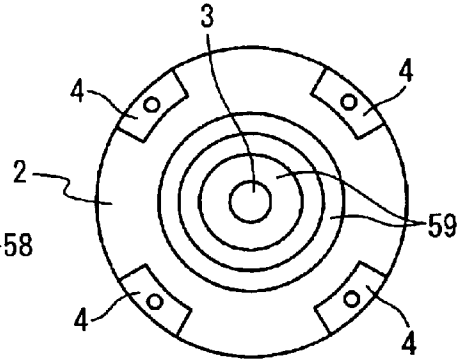
Fig. 15E

PHYSICALLY SMALL ANTENNA

BACKGROUND OF THE INVENTION

1. Field of the Invention

The present invention relates, in general to an antenna, more particularly to a physically small surface mount type antenna.

2. Description of the Related Art

The development of wireless local area network (wireless LAN) technologies increases demand for physically small antennas. An instrument including an antenna that constitutes a wireless LAN system is often required to be small, and this heightens the need for physically small antennas. Physically small antennas suitable for wireless LAN systems are disclosed in Japanese Open Laid Patent Application (Jp-A-Heisei 8-84019, Jp-A-Heisei 8-97626, Jp-A-Heisei 9-74308, Jp-A-Heisei 9-74309, and Jp-A-Heisei 10-41736) and Japanese Registered Utility Model Gazette (Jp-U 3041690). "Antennas and Radio Propagation", which is published by Corona Publishing Co., Ltd. in Japan, discloses in pages 69 and 70 that top-loading effectively reduces the size of the antenna.

An antenna used in a wireless LAN technology is desired to meet several requirements. Firstly, an antenna is desirably designed to have a wider bandwidth. In recent years, many countries tend to allocate wider frequency ranges to wireless LAN systems. This situation heightens the need for a physically small antenna that has a wider bandwidth.

Second, a cost of an antenna is desirably reduced. The cost of manufacture is one of the important factors to determine competitiveness of manufacturers of antennas.

Third, an antenna is desirably easy to adjust its characteristics, such as the input impedance and the resonance frequency. The fabrication process of an instrument with an antenna usually includes adjustment of the characteristics of the antenna. The easy adjustment of the characteristics is quite advantageous to improve efficiency of the fabrication process.

Fourth, an antenna is desirably designed to be suitable for automatic surface mounting, because the use of the automatic surface mounting effectively reduces the cost needed for mounting an antenna onto a printed circuit board. The automatic surface mounting includes automatic positioning and automatic soldering. Thus, it would be advantageous if the antenna has a structure suitable for automatic positioning and automatic soldering.

Fifth, an antenna desirably has a structure that facilitates a visual inspection to confirm the connection between the antenna and the printed circuit board.

SUMMARY OF THE INVENTION

Therefore, an object of the present invention is to provide a physically small antenna that has a wider bandwidth.

Another object of the present invention is to provide a physically small antenna superior in cost.

Still another object of the present invention is to provide a physically small antenna that is easy to adjust the characteristics thereof.

Yet still another object of the present invention is to provide a physically small antenna that is suitable for automatic surface mounting.

It is also an object of the present invention to provide a physically small antenna having a structure that facilitates a visual inspection to confirm the connection to a printed circuit board.

In an aspect of the present invention, an antenna is provided with a dielectric plate having a rear surface, a conductive plate disposed on the rear surface, a vertical element extending in a direction perpendicular to the rear surface. The vertical element includes a dielectric bar, an end of which is attached to the rear surface, and a conductive shell covering a side and an opposite end of the dielectric bar to be attached to the conductive plate.

The antenna is preferably provided with at least one dielectric leg on the rear surface, the dielectric leg being extending in the direction perpendicular to the rear surface.

The dielectric plate, the dielectric bar, and the dielectric leg are preferably molded into a single-piece.

It is preferable that an end of the dielectric leg is attached to the dielectric plate, and another end of the dielectric leg is covered with a conductor.

The other end of the leg is preferably provided with a boss protruding in the direction perpendicular to the rear surface. In this case, the other end of the leg and the boss is preferably covered with a conductor.

It would be advantageous if an end of the conductive shell is attached to the dielectric plate and another end of the conductive shell is rounded.

When the dielectric plate and the dielectric bar are fabricated through molding, the dielectric bar is advantageously tapered down to the opposite end to facilitate detachment of the dielectric plate and the dielectric bar from the metal mold.

The dielectric plate is desirably provided with a hole to finely adjust the input impedance and resonance frequency of the antenna. When the dielectric plate is circular, the hole is preferably provided at the center of the dielectric plate.

When an end of the leg is attached to the dielectric plate, and another end of the leg is covered with a first conductor, it would be advantageous if a portion of a side of the leg is covered with a second conductor. The second conductor allows fine adjustment of the input impedance and resonance frequency of the antenna. The second conductor is advantageously detachable from the leg. It should be noted that the second conductor may be electrically connected to the first conductor.

The antenna preferably further includes a characteristic modifying conductor on the dielectric plate.

In a preferable use, the conductive shell is electrically connected to a stripline, and the conductor provided on the end of the leg is electrically connected to a grounded conductor.

In another aspect of the present invention, a method for adjusting characteristics of an antenna includes:

providing an antenna including:

a dielectric plate having a rear surface, a conductive plate disposed on the rear surface, a vertical element extending in a direction perpendicular to the rear surface, the vertical element comprising:

a dielectric bar, an end of which is attached to the rear surface, and a conductive shell covering a side and an opposite end of the dielectric bar, and a conductor provided on the dielectric plate; and removing at least a portion of the conductor.

When the method further includes mounting the antenna onto a printed circuit board, the removing may be executed after the coupling.

In still another aspect of the present invention, method for adjusting characteristics of an antenna includes:

providing an antenna including:

a dielectric plate having a rear surface, a conductive plate disposed on the rear surface, a vertical element extending in a direction perpendicular to the rear surface, the vertical element comprising:

a dielectric bar, an end of which is attached to the rear surface, and a conductive shell covering a side and an opposite end of the dielectric bar, and a dielectric leg disposed on the rear surface to extend in the direction;

a conductor provided on the dielectric leg; and removing at least a portion of the conductor.

BRIEF DESCRIPTION OF THE DRAWINGS

FIGS. 14A to 14F and FIGS. 15A to 15E show other modifications of the antenna according to the present invention;

DESCRIPTION OF THE PREFERRED EMBODIMENTS

Figure 1A:
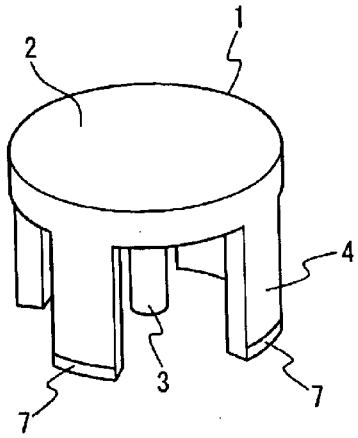
FIGS. 1A and 1B are perspective views of an antenna 1 in an embodiment according to the present invention.
Figure 1B:
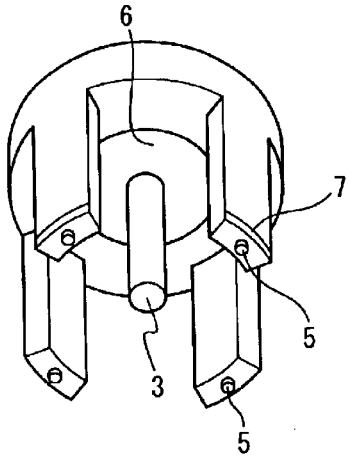
Figure 2A:
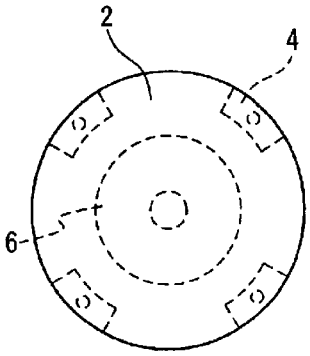
FIG. 2A is a top plan view of the antenna 1.
Figure 2B:
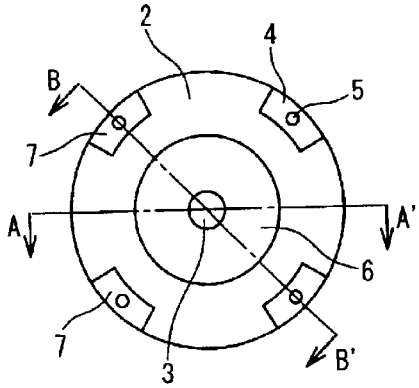
FIG. 2B is a bottom plan view of the antenna 1.

FIGS. 1A and 1B show an antenna in an embodiment of the present invention. The antenna 1 includes a dielectric plate 2, a cylindrical vertical element 3, and a conductive plate 6. As shown in FIGS. 2A and 2B, the dielectric plate 2 and the conductive plate 6 are circular. The vertical element 3 and the conductive plate 6 are coaxially disposed on the rear surface of the dielectric plate 2. The vertical element 3 extends in a direction perpendicular to the rear surface of the dielectric plate 2 without penetrating the dielectric plate 2.

Figure 3A:
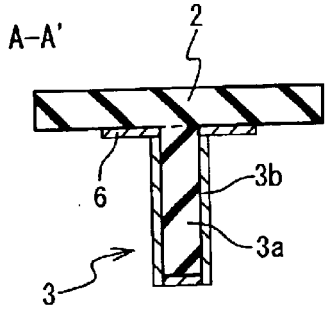
FIG. 3A is a sectional view of the antenna 1 on the section A–A'.
Figure 3B:
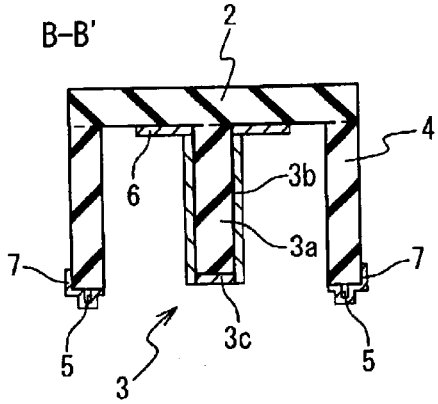
FIG. 3B is a sectional view of the antenna 1 on the section B–B'.

As shown in FIGS. 3A and 3B, the vertical element 3 includes a cylindrical dielectric bar 3*a*, and a cylindrical conductive shell 3*b*. The dielectric bar 3*a* is disposed in contact with the rear surface of the dielectric plate 2 at one of the ends through a hole provided for the conductive plate 6. The other end and the side of the dielectric bar 3*a* are covered with the conductive shell 3*b*. One of the ends of the cylindrical conductive shell 3*b* is attached to the conductive plate 6. The attached end of the cylindrical conductive shell 3*b* is aligned to the edge of the hole provided through the conductive plate 6.

A feed point 3*c* of the antenna 1 is provided at the opposite end of the cylindrical conductive shell 3*b* to operate the conductive shell 3*b* as a radiating and/or receiving element.

As shown in FIG. 1B, four dielectric legs 4 are disposed on the rear surface of the dielectric plate 2 at the edge of the dielectric plate 2. The dielectric legs 4 and the vertical element 3 are disposed on the same side of the dielectric plate 2. As shown in FIG. 2B, the dielectric legs 4 are symmetrically arranged with respect to the vertical element 3.

As shown in FIGS. 3A and 3B, the dielectric legs 4 are respectively provided with bosses 5 on the ends thereof. The bosses 5 protrude in the direction perpendicular to the rear surface of the dielectric plate 2. The bosses 5 are used for positioning of the antenna 1 when the antenna 1 is attached to a printed circuit board.

The dielectric plate 2, the dielectric bar 3*a*, and the dielectric legs 4 are preferably fabricated in a single piece through integral molding.

Figures 4A, 4B, 4C:
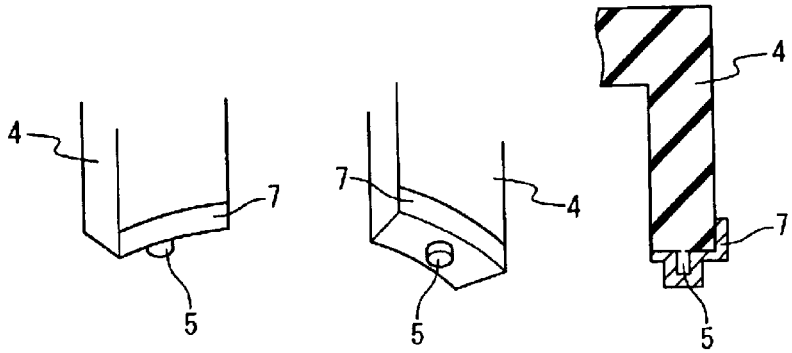
FIGS. 4A to 4C are enlarged perspective views of conductors 7.

The ends of the dielectric legs 4 and the bosses 5 are respectively covered with conductors 7. As shown in FIGS. 4A to 4C, portions of the sides of the dielectric legs 4 are also covered with the conductors 7 in the vicinity of the ends. As described below, the conductors 7 are grounded when the antenna 1 is in operation.

Figure 20:
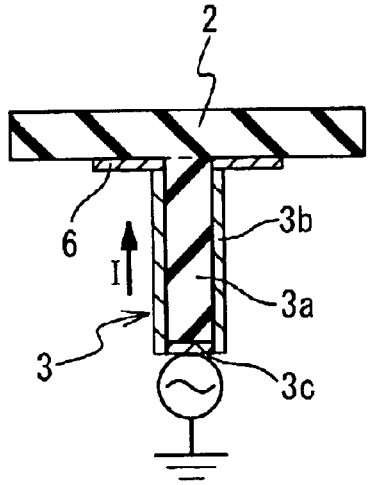
FIG. 20 shows operations of the antenna 1.

The antenna 1 has several advantages described in the following. First, the antenna 1 has a wide bandwidth. FIG. 20 shows the operations of the antenna 1. When the antenna 1 is in operation, a high frequency current flows through the conductive shell 3*b*. The high frequency current may be generated by applying electromagnetic wave having a vertical polarization or feeding the antenna 1 at the feed point 3*c*. The "shell" structure of the conductive shell 3*b* allows currents having various frequencies to flow through the conductive shell 3*b*. A current having a relatively low frequency flows through a vertical path, and a current having a relatively high frequency flows through a slanting path. This allows the antenna 1 to have a wide bandwidth.

The antenna 1 has substantially no gain for a electromagnetic wave having the horizontal polarization because the effects of the radial currents through the circular conductive plate 6 are canceled. It should be noted that the antenna 1 may have some gain for the horizontal polarization if the conductive plate 6 is not perfectly symmetric as shown in FIGS. 15A and 15D.

Second, the structure of the antenna 1 allows the antenna 1 to have a small size. The conductive plate 6 functions as a capacitor for top loading, and thus effectively reduces the size of the antenna 1. In addition, the dielectric plate 2 and the dielectric bar 3*a* shorten the wavelength of the electromagnetic wave in the vicinity of the cylindrical conductive shell 3*b* and the conductive plate 6, and thus allow the antenna 1 to be small for a desired frequency range. For example, when the antenna 1 is designed to operate at a frequency around 5 GHz and the relative dielectric constants of the dielectric plate 2 and the dielectric bar 3*a* are about 4, the length and the diameter of the cylindrical conductive shell 3*b* are respectively about 5 mm, and 1 mm, and the radius of the conductive plate 6 is about 3 mm.

Third, the structure of the antenna 1 is suitable for automatic surface mounting. The bosses 5 provided at the ends of the dielectric legs 4 help the antenna 1 to be secured to a desired position.

Fourth, the structure of the antenna 1 facilitates a visual inspection for confirming the connection between the feed point 3*c* and a printed circuit board. The reliability of the connection between the feed point 3*c* and a printed circuit board is of importance for reliable operations of the antenna 1. Therefore the connection is desirably confirmed through a visual inspection. The structure of the antenna 1 effectively prevents the dielectric plate 2 from interfering with the line of vision to the area around the feed point 3*c*, where the antenna 1 is attached to a printed circuit board. This helps visual inspections to confirm the reliable connection between the feed point 3*c* and a printed circuit board.

Figure 5:
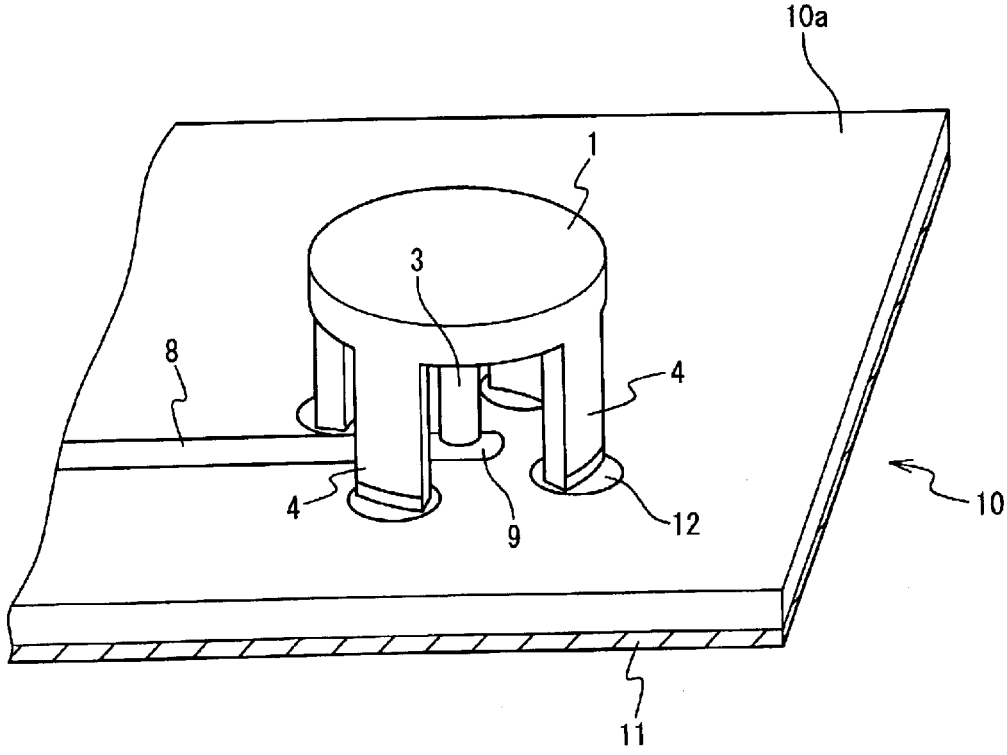
FIG. 5 is a perspective view of a printed circuit board 10 onto which the antenna 1 is mounted.
Figure 6:
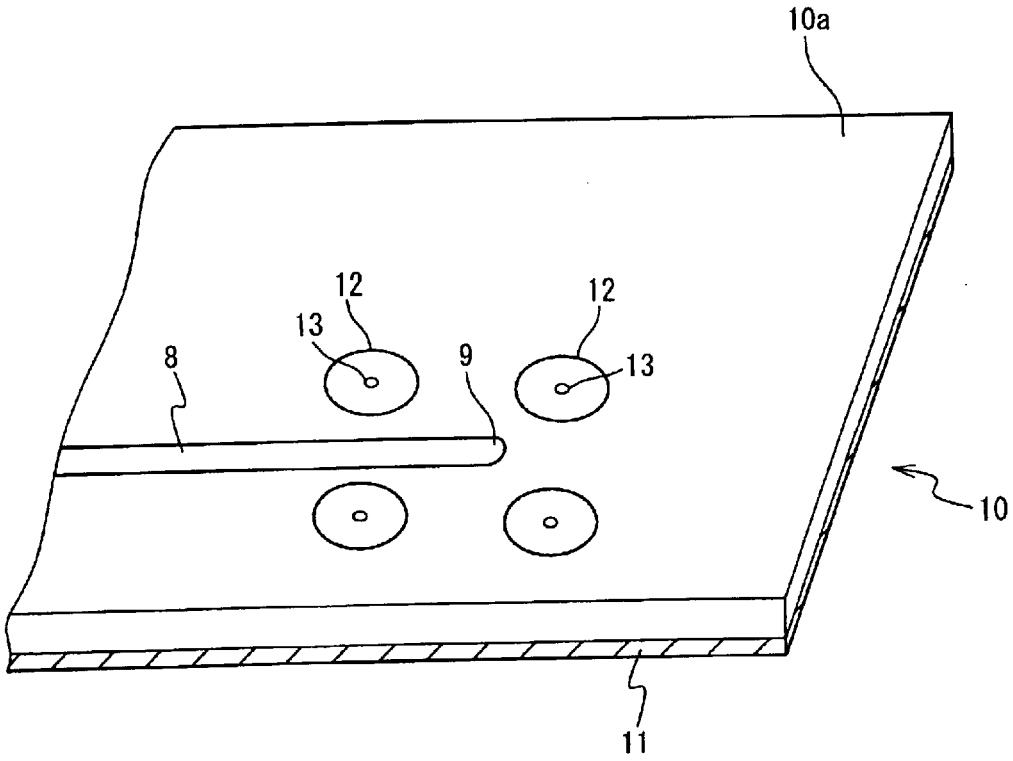
FIG. 6 is a perspective view of a printed circuit board 10.

For instance, FIG. 5 shows a printed circuit board 10 onto which the antenna 1 is mounded. As shown in FIG. 6, the printed circuit board 10 includes a dielectric substrate 10*a*, a copper stripline 8 formed on the main surface of the substrate 10*a*, copper lands 12 formed on the main surface, and a copper grounded conductive plate 11 on the rear surface of the substrate 10*a*. As described below, the lands 12 are short-circuited to the grounded conductive plate 11 to be grounded.

To attach the antenna 1 to the printed circuit board, the conductors 7 are soldered to the lands 12, and the feed point 3*c* of the vertical element 3 is soldered to the stripline 8 at a point 9 positioned in the vicinity of the end of the stripline 8.

Figure 7:
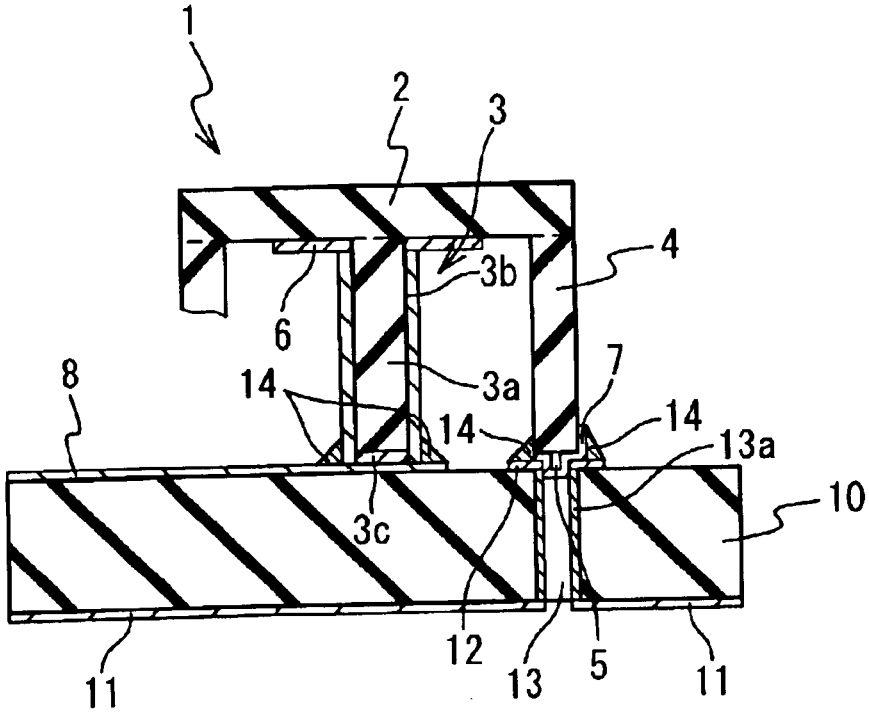
FIG. 7 is a sectional view of the printed circuit board 10 and the antenna 1.

FIG. 7 shows a sectional view of the antenna 1 and the printed circuit board. Through holes 13 are provided through the substrate 10*a*, the lands 12 and the grounded conductive plate 11. It should be noted that only one of the through holes 13 is shown in FIG. 7. The sides of the through holds 13 are respectively covered with cylindrical conductors 13*a*, and the respective conductors 13*a* electrically connect the lands 12 to the grounded conductive plate 11. The conductors 7 at the ends of the dielectric legs 4 are electrically connected to the grounded conductive plate 11 to be earthed through the lands 12, and the cylindrical conductors 13*a*.

The through holes 13 respectively accommodate the bosses 5 (and protruding portions of the conductor 7) to achieve the positioning of the antenna 1. The vertical element 3 is soldered to the stripline 8 and the conductors 7 are respectively soldered to the lands 12 by solder 14 with the bosses 5 inserted into the through holes 13. The insertion of the bosses 5 into the through holes 13 achieves the positioning of the antenna 1. Therefore, the bosses 5 facilitates the automatic positioning of the antenna 1, and thus facilitates the automatic soldering of the antenna 1 and the printed circuit board.

In addition, as shown in FIG. 5, a line of vision to the area around the feed point 3*c* passes between the dielectric legs 4. Therefore, one can easily confirm the secure connection between the vertical element 3 and the stripline 8 at the feed point 3*c* through a visual inspection.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

For example, the bosses 5 may not be provided for the dielectric legs 4 if the bosses 5 are not necessary.

Figure 8:
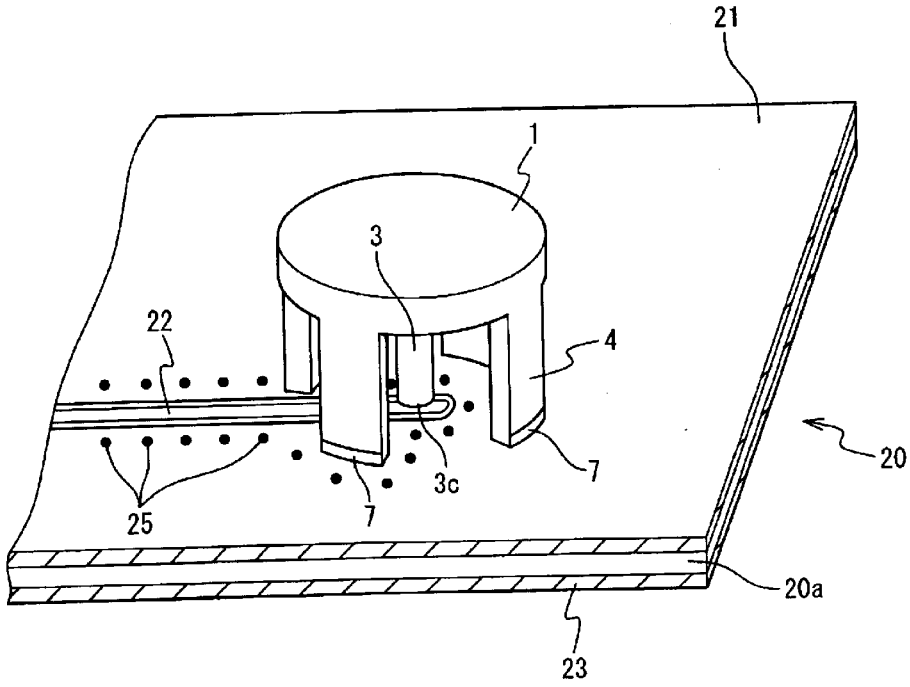
FIG. 8 is a perspective view of a printed circuit board 20 onto which the antenna 1 is mounted.

In addition, the antenna 1 may be mounted onto printed circuit boards having different structures from that of the printed circuit board 10. FIG. 8 shows another printed circuit board 20 onto which the antenna 1 is mounded. The printed circuit board 20 is provided with a substrate 20*a*, a grounded conductive plate 21, a stripline 22, and a grounded conductive plate 23. The grounded conductive plate 21 and the stripline 22 are disposed on the main surface of the substrate 20*a*, and the grounded conductive plate 23 is disposed on the rear surface of the substrate 20*a*. The stripline 22 is soldered to the vertical element 3 at the feed point 3*c*, while the grounded conductive plate 21 is soldered to the conductors 7 at the ends of the dielectric legs 4.

Figure 9:
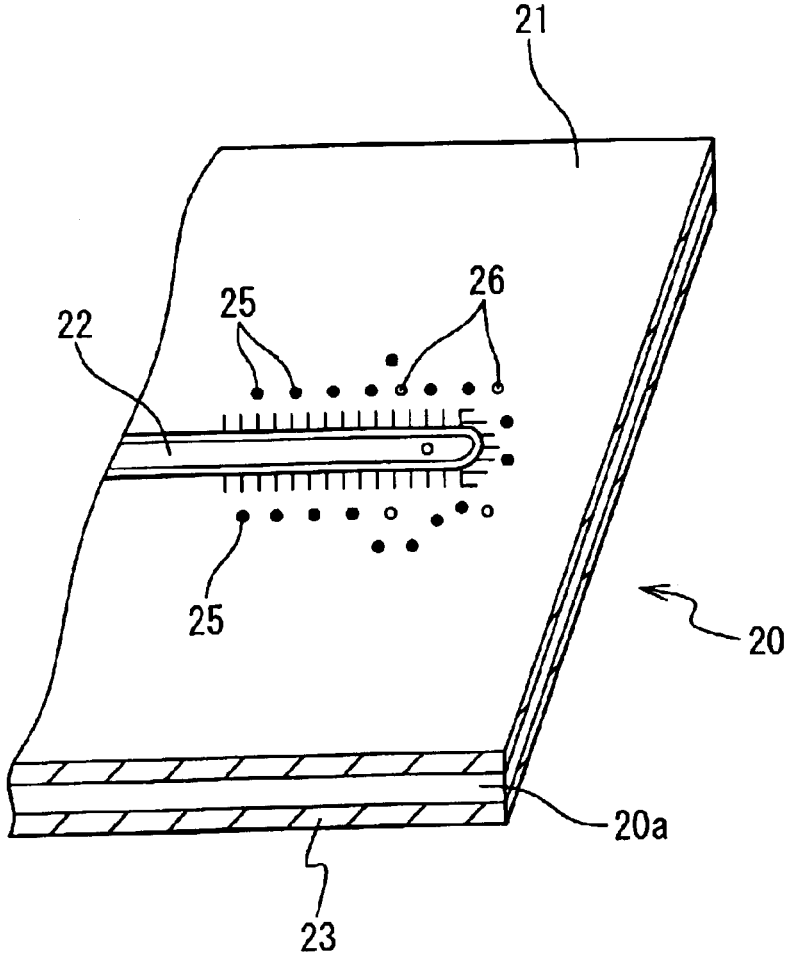
FIG. 9 is a perspective view of the printed circuit board 20.

As shown in FIG. 9, through holes 25 and 26 are provided through the substrate 22, and the grounded conductive plates 21 and 23.

The through holes 25 are used for achieving the short-circuiting between the grounded conductive plates 21 and 23. The sides of the through holes 25 are covered with a conductor (not shown), and the grounded conductive plates 21 and 23 are short-circuited by the conductor on the through holes 25. To ensure the short-circuiting at high frequencies, the through hole 25 are preferably provided at intervals of a twentieth to a fifth of the wavelength of the electromagnetic wave transmitted or received by the antenna 1.

The through holes 26 are provided to help the positioning of the antenna 1. The through holes 26 accommodate the bosses 5. The vertical elements 3 and the conductors 7 are soldered with the bosses 5 inserted into the through holes 26. The insertion of the bosses 5 into the through holes 5 achieves the positioning of the antenna 1.

Figure 10:
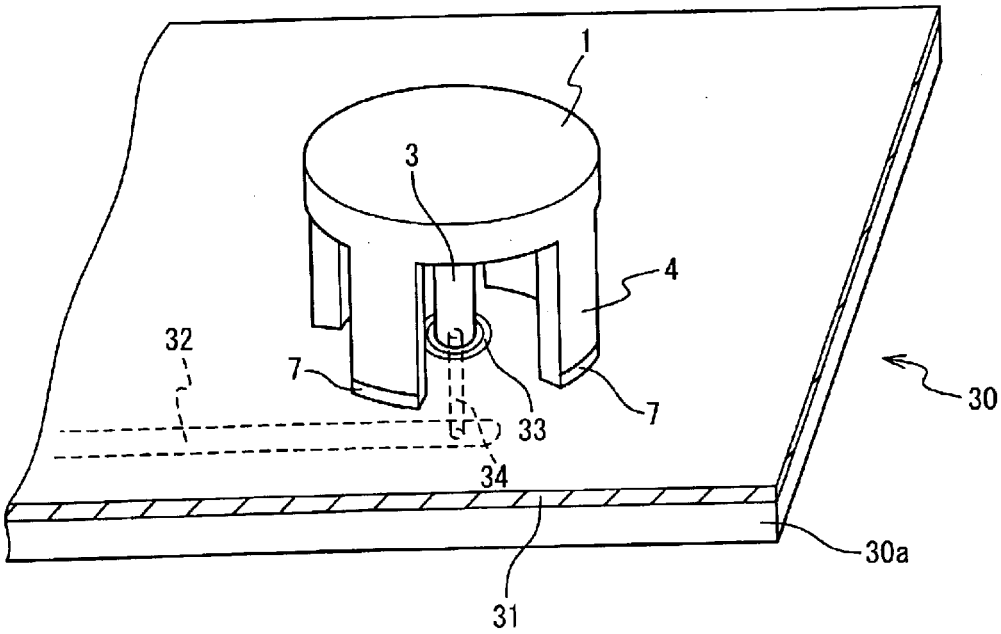
FIG. 10 is a perspective view of a printed circuit board 30 onto which the antenna 1 is mounted.

FIG. 10 shows still another printed circuit board 30 onto which the antenna 1 are mounted. The printed circuit board 30 is provided with a substrate 30*a*, a grounded conductive plate 31, a stripline 32, and a land 33. The land 33 is electrically isolated from the grounded conductive plate 31. The grounded conductive plate 31 and the land 33 are disposed on the main surface of the substrate 30*a*. The stripline 32 is disposed on the rear surface of the substrate 30*a*, which is represented by a broken line. The grounded conductive plate 31 is soldered to the conductors 7 at the ends of the dielectric legs 4, and the land 33 is soldered to the vertical element 3 at the feed point 3*c*.

Figure 11:
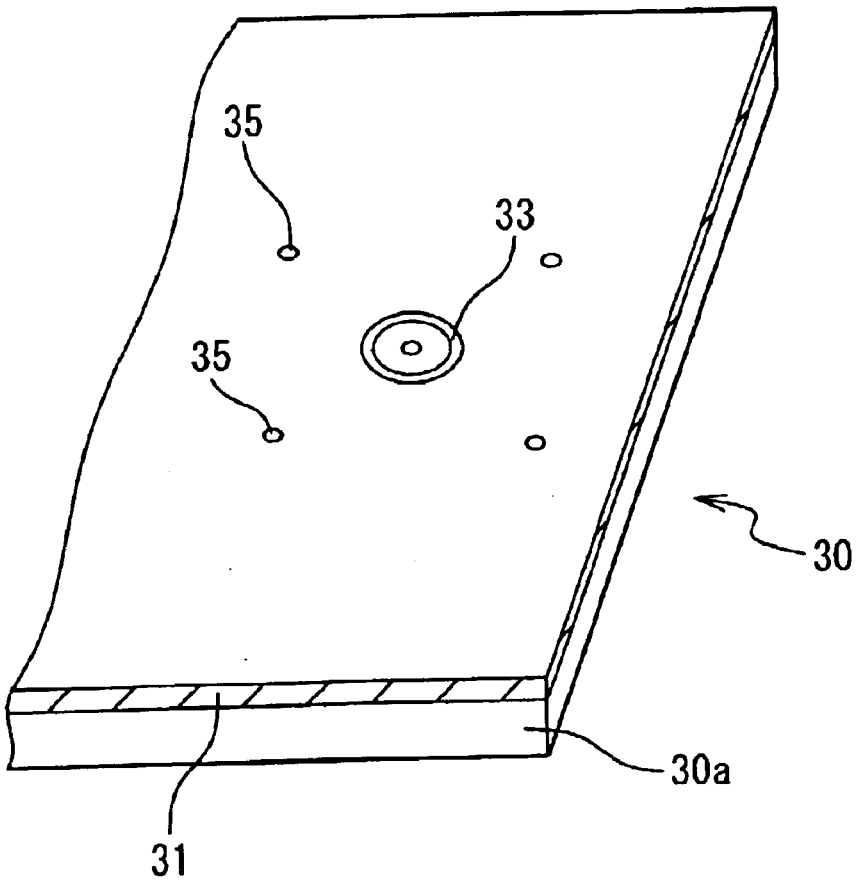
FIG. 11 is a perspective view of the printed circuit board 30.

As shown in FIG. 11, through holes 35 are provided through the substrate 30*a* and the grounded conductive plate 31. The through holes 35 accommodate the bosses 5 at the ends of the dielectric legs 4 to position the antenna 1 to a desired place.

Figure 12A:
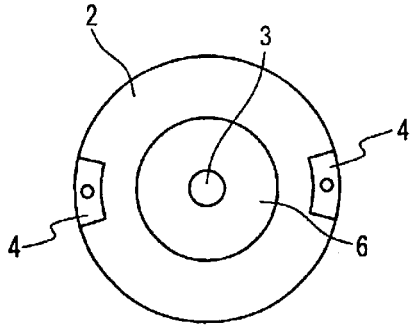
FIGS. 12A and 12B show modifications of the antenna according to the present invention.
Figure 12B:
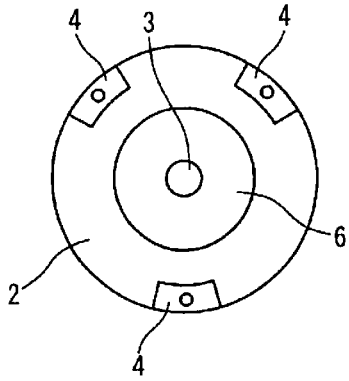

It should be also noted that the number of the dielectric legs 4 may be increased or decreased. As shown in FIGS. 12A and 12B, the number of the dielectric legs 4 may be two or three or other number.

Figure 13A:
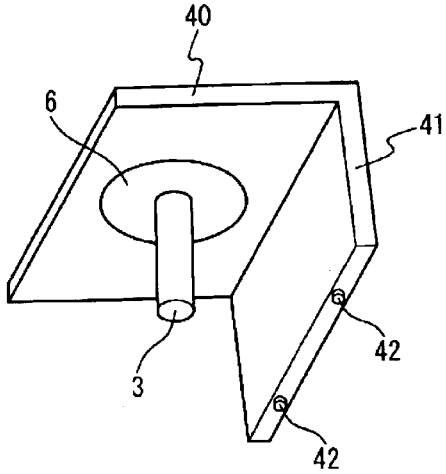
FIG. 13A is a perspective view of another modification of the antenna according to the present invention.
Figure 13B:
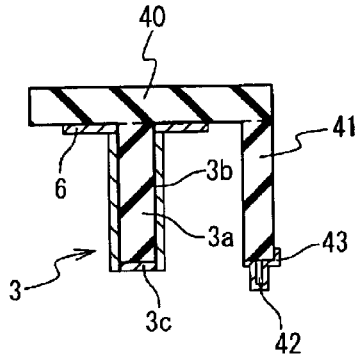
FIG. 13B is a section view of the modification of the antenna shown in FIG. 13A.
Figure 14A:
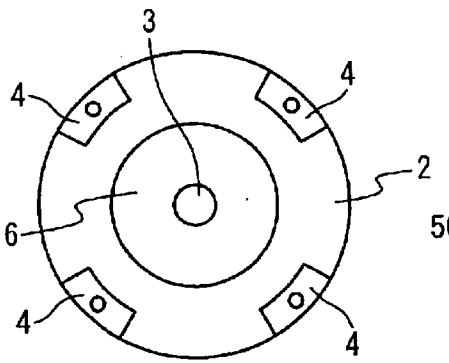
Figure 14B:
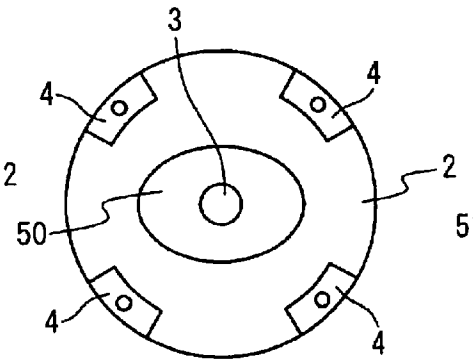
Figure 14C:
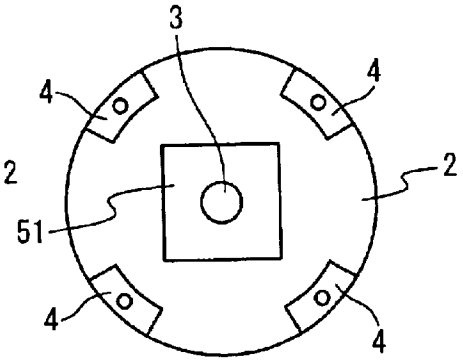
Figure 14D:
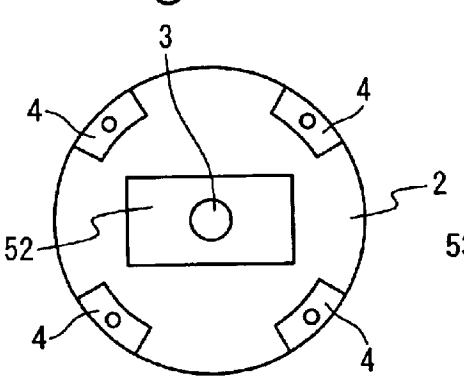
Figure 14E:
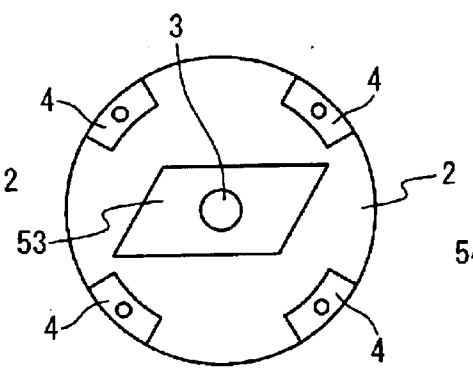
Figure 14F:
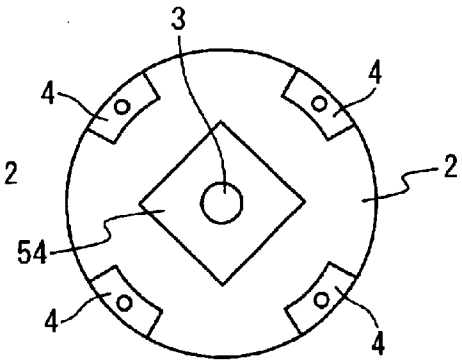

As shown in FIGS. 13A and 13B, the dielectric legs 4 may be replaced with a single dielectric leg 41 that has a wider width. In this case, the circular dielectric plate 2 is preferably replaced with a rectangular dielectric plate 40.

The single dielectric leg 41 is preferably provided with a plurality of bosses 42 protruding in the direction perpendicular to the rear surface of the dielectric plate 41 (or dielectric plate 2). In this case, the end of the dielectric leg 41 and the bosses 42 are covered with a conductor 43. The plurality of the bosses 42 allow the antenna 1 to be firmly attached to a printed circuit board.

As shown in FIGS. 14A to 14F and FIGS. 15A to 15F, the shape of the conductive plate 6 may be modified. FIGS. 14B to 14F show exemplary shapes of the conductive plate 6. As respectively shown in FIG. 14B to FIG. 14F, the circular conductive plate 6 may be replaced with an oval conductive plate 50, a square conductive plate 51, a rectangular conductive plate 52, a parallelogram conductive plate 53, or a rhombic conductor plate 54.

FIGS. 15A to 15F show other exemplary shapes of the conductive plate 6. As respectively shown in FIGS. 15A to 15F, the circular conductive plate 6 may be replaced with a trapezoid conductor plate 55, an octagonal conductor plate 56, a cruciform conductor plate 57, a planar spiral conductor plate 58, or a set of double annular conductor plates 59.

Figure 16A:
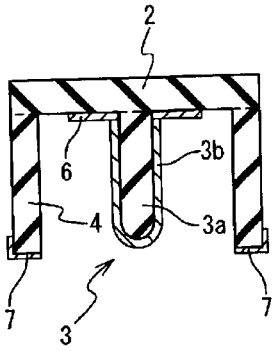
FIGS. 16A to 16C show still other modifications of the antenna according to the present invention.

The shape of the vertical element 3 may be modified. As shown in FIG. 16A, the ends of the dielectric bar 3*a* and the conductive shell 3*b* may be hemispherically rounded. The rounded ends effectively increase the size of the contact surface where the conductive shell 3*b* is soldered to a printed circuit board, and thus improves the reliability of the connection between the antenna 1 and the printed circuit board.

Figure 16B:
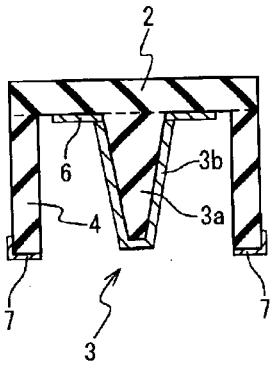

As shown in FIG. 16B, the dielectric bar 3*a* and the conductive shell 3*b* may be tapered down to the ends thereof. For example, the dielectric bar 3*a* may be a frustum of a circular cone or pyramid, and the conductive shell 3*b* may be a hollow frustum of a circular cone or pyramid. The tapered shape of dielectric bar 3*a* is advantageous when the dielectric plate 2, the dielectric bar 3*a* are fabricated in a unit through integral molding. The tapered shape of dielectric bar 3*a* facilitates the dielectric bar 3*a* to be detached from a metal mold while molding. It should be noted that the dielectric legs 4 may be molded in a unit with the dielectric plate 2 and the dielectric bar 3*a*. In addition, the tapered shape of the dielectric bar 3*a* and the conductive shell 3*b* broadens the bandwidth of the antenna 1.

Figure 16C:
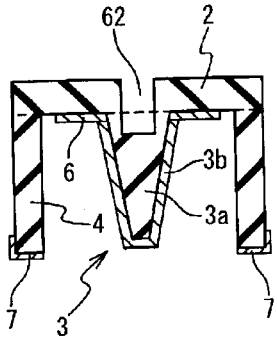

As shown in FIG. 16C, it may be advantageous that the dielectric plate 2 is provided with a hole 62. The hole 62 allows the characteristics of the antenna 1 to be finely adjustable. The input impedance and the resonance frequency of the antenna 1 may be adjusted to a desired value by the hole 62.

As shown in FIGS. 17A to 17C, 18A to 18C, and 19, detachable conductor patterns, which are denoted by numerals 70 to 72, 80 to 82, and 90, may be formed on the dielectric plate 2 and/or the dielectric legs 4. The use of the conductor pattern(s) on the dielectric plate 2 and/or the dielectric legs 4 allows the characteristics of the antenna 1 to be precisely adjusted. The adjustment of the characteristics of the antenna 1 is achieved as follows. The antenna 1 is fabricated with a conductor pattern(s) attached to the dielectric plate 2 and/or the dielectric legs 4. After the antenna 1 is tested, at least a portion of the conductor pattern(s) is removed so as to adjust the characteristics of the antenna 1 to desired values. The input impedance and the resonance frequency of the antenna 1 depend on the shape of the attached conductor pattern(s), and thus the removal of the portion of the conductor pattern(s) allows the antenna 1 to have the desired input impedance and resonance frequency.

The removal of the portion of the conductor pattern(s) may be executed after the antenna 1 is mounted onto a printed circuit board. This means that a test and an adjustment of the antenna 1 can be achieved after the antenna 1 is installed into an instrument. Other components of an instrument, such as a housing, may change the resonance frequency of the antenna 1. The conductor pattern(s) formed on the dielectric plate 2 and/or the dielectric legs 4 enables the adjustment for canceling the effect(s) of the other components.

Figure 17A:
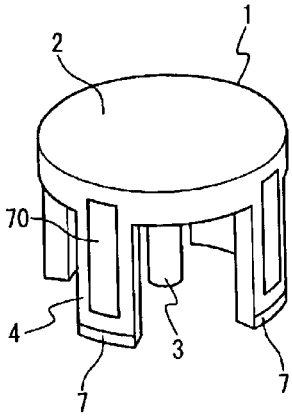
FIGS. 17A to 17C, 18A to 18C, and 19 show yet still other modifications of the antenna according to the present invention.
Figure 17B:
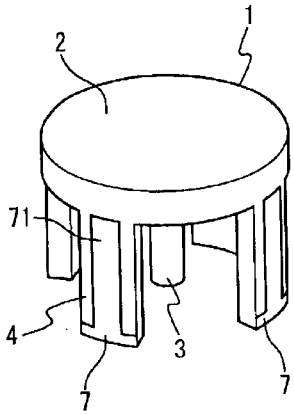
Figure 17C:
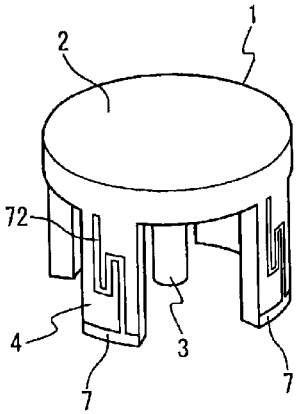

A variety of conductor patterns may be used. As shown in FIGS. 17A to 17C, conductor patterns 70 to 72 may be formed on the dielectric legs 4 to extend in the vertical direction along the sides of the dielectric legs 4. As shown in FIGS. 17B and 17C, the conductor patterns 71 and 72 may be connected to the conductors 7 at the ends of the dielectric legs 4. As shown in FIG. 17C, the conductor patterns may be cranked.

Figure 18A:
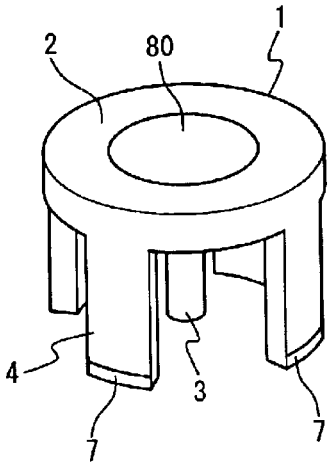
Figure 18B:
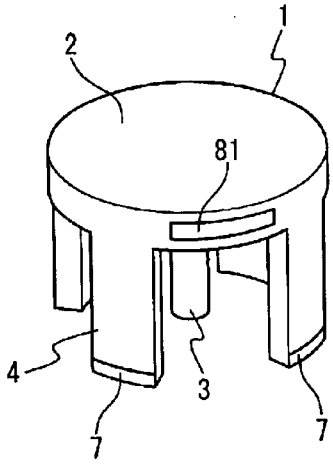
Figure 18C:
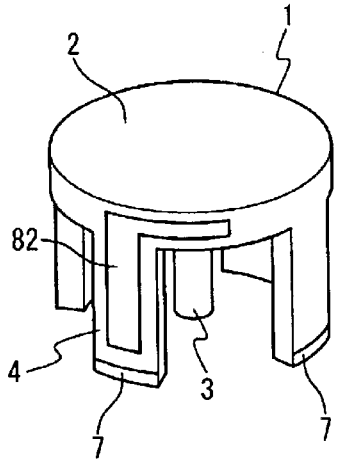

As shown in FIGS. 18A to 18C, the conductor pattern(s) may be formed on the dielectric plate 2. As shown in FIG. 18A, a conductor pattern 80 may be formed on the upper surface of the dielectric plate 2. The shape of the conductor pattern 80 may be modified. For example, the conductor pattern 80 may be circular as shown in FIG. 18A, or rectangular. As shown in FIG. 18B, conductor patterns 81 are formed on the side of the dielectric plate 2. As shown in FIG. 18B, conductor patterns 82 may be formed on the side of the dielectric plate 2 bridging over to the side of the dielectric legs 4.

Figure 19:
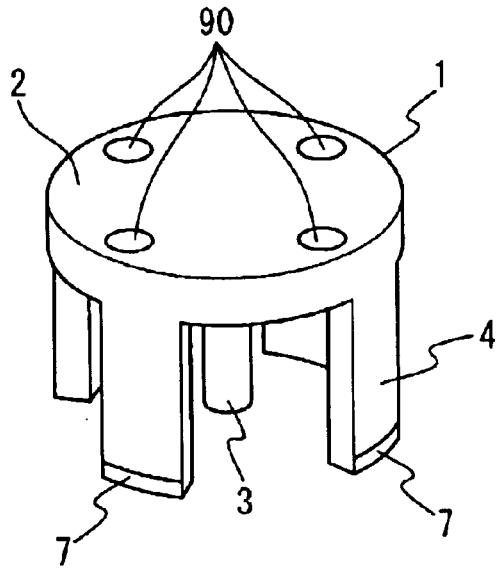

As shown in FIG. 19, a plurality of small conductor patterns 90 may be formed on the upper surface of the dielectric plate 2.

What is claimed is:

1. An antenna comprising:

a dielectric plate having a rear surface;

a conductive plate disposed on said rear surface;

a vertical element extending in a direction perpendicular to said rear surface, wherein said vertical element includes:

a dielectric bar, an end of which is attached to said rear surface, and a conductive shell covering a side and an opposite end of said dielectric bar, said conductive shell being attached to said conductive plate;

at least one dielectric leg disposed on said rear surface, said dielectric leg extending in said direction perpendicular to said rear surface, said dielectric leg having a sidewall; and a conductor attached to an end of said dielectric leg, wherein at least a portion of said sidewall of said dielectric leg is not covered by said conductor or by any other conductor material.

2. The antenna according to claim 1, wherein said dielectric plate, said dielectric bar, and said dielectric leg are molded into a single piece.

3. The antenna according to claim 1, wherein another end of said dielectric leg is attached to said dielectric plate.

4. The antenna according to claim 1, wherein an end of said conductive shell is attached to said dielectric plate, and another end of said conductive shell is rounded.

5. The antenna according to claim 1, wherein said dielectric bar is tapered down to said opposite end thereof.

6. The antenna according to claim 1, wherein said dielectric plate is provided with a hole.

7. The antenna according to claim 6, wherein said dielectric plate is circular and said hole is provided at the center of said dielectric plate.

8. The antenna according to claim 1, wherein an end of said dielectric leg is attached to said dielectric plate, another end of said dielectric leg is covered with a first conductor, and a portion of a side of said dielectric leg is covered with a second conductor.

9. The antenna according to claim 8, wherein said second conductor is electrically connected to said first conductor.

10. The antenna according to claim 8, wherein said second conductor is detachable from said dielectric leg.

11. The antenna according to claim 1, further comprising a characteristic modifying conductor disposed on said dielectric plate.

12. The antenna according to claim 1, wherein all portions of said sidewall of said dielectric leg are exposed to an exterior and are not covered by any conductor material.

13. An antenna comprising:

a dielectric plate having a rear surface;

a conductive plate disposed on said rear surface;

a vertical element extending in a direction perpendicular to said rear surface, wherein said vertical element includes:

a dielectric bar, an end of which is attached to said rear surface, and a conductive shell covering a side and an opposite end of said dielectric bar, said conductive shell being attached to said conductive plate, wherein an end of said dielectric leg is attached to said dielectric plate, and another end of said dielectric leg is provided with a boss protruding in said direction perpendicular to said rear surface.

14. The antenna according to claim 13, wherein said another end of said dielectric leg and said boss is covered with a conductor.

15. A method for adjusting characteristics of an antenna comprising:

providing an antenna including:

a dielectric plate having a rear surface, a conductive plate disposed on said rear surface, a vertical element extending in a direction perpendicular to said rear surface, said vertical element comprising:

a dielectric bar, an end of which is attached to said rear surface, and a conductive shell covering a side and another end of said dielectric bar, and a first conductor provided on said dielectric plate; and at least one dielectric leg disposed on said rear surface, said dielectric leg extending in said direction perpendicular to said rear surface, said dielectric leg having a sidewall; and a second conductor attached to an end of said dielectric leg, wherein at least a portion of said sidewall of said dielectric leg is not covered by said second conductor or by any other conductor material, and removing at least a portion of said first conductor.

16. The method according to claim 15, wherein all portions of said sidewall of said dielectric leg are exposed to an exterior and are not covered by any conductor material.

17. A method for adjusting characteristics of an antenna comprising:

providing an antenna including:

a dielectric plate having a rear surface, a conductive plate disposed on said rear surface, a vertical element extending in a direction perpendicular to said rear surface, said vertical element comprising:

a dielectric bar, an end of which is attached to said rear surface, and a conductive shell covering a side and another end of said dielectric bar, and a conductor provided on said dielectric plate; and removing at least a portion of said conductor; and mounting said antenna onto a printed circuit board, wherein said removing is executed after said mounting.

18. A method for adjusting characteristics of an antenna comprising:

providing an antenna including:

a dielectric plate having a rear surface, a conductive plate disposed on said rear surface, a vertical element extending in a direction perpendicular to said rear surface, said vertical element comprising:

a dielectric bar, an end of which is attached to said rear surface, and a conductive shell covering a side and another end of said dielectric bar, and a dielectric leg disposed on said rear surface to extend in said direction, and a conductor provided on said dielectric leg; and removing at least a portion of said conductor; and mounting said antenna onto a printed circuit board, wherein said removing is executed after said mounting.

19. A circuitry comprising:

a printed circuit board including:

a substrate, and a transmission line including:

a stripline formed on said substrate, and a grounded conductive plate formed on said substrate; and an antenna including:

a dielectric plate having a rear surface, a conductive plate disposed on said rear surface, a vertical element extending in a direction perpendicular to said rear surface, said vertical element comprising:

a dielectric bar, an end of which is attached to said rear surface, and a conductive shell covering a side and another end of said dielectric bar to be attached to said conductive plate, a dielectric leg, an end of which is attached to said rear surface to extend in said direction, and a conductor disposed on another end of said dielectric leg, wherein said conductive shell is electrically connected to said stripline, and said conductor is electrically connected to said grounded conductive plate.

* * * * *